US006345410B1

(12) United States Patent
Baker

(10) Patent No.: US 6,345,410 B1
(45) Date of Patent: Feb. 12, 2002

(54) DRAIN OPENING DEVICE

(76) Inventor: John G. Baker, 1002 S. Rooselvelt St., Green Bay, WI (US) 54301

( * ) Notice: Subject to any disclaimer, the term of this patent is extended or adjusted under 35 U.S.C. 154(b) by 0 days.

(21) Appl. No.: 09/770,262

(22) Filed: Jan. 26, 2001

(51) Int. Cl.[7] ..... A47L 5/00
(52) U.S. Cl. ..... 15/406
(58) Field of Search ..... 15/405, 406, 407; 4/255.04, 255.06

(56) References Cited

U.S. PATENT DOCUMENTS

| | | | | |
|---|---|---|---|---|
| 2,300,319 A | * | 10/1942 | Smith | 15/406 X |
| D155,489 S | | 10/1949 | Wetzler | |
| 2,673,986 A | | 4/1954 | Schaefer | |
| 2,714,898 A | * | 8/1955 | Reese | 15/406 X |
| 3,062,152 A | | 11/1962 | Huff | |
| 3,189,934 A | * | 6/1965 | Steinwedel | 15/406 |
| 3,730,209 A | | 5/1973 | Binard et al. | |
| 4,141,090 A | | 2/1979 | Rowan | |
| 5,193,245 A | | 3/1993 | Brzoska | |
| D404,178 S | | 1/1999 | Wetzler | |

* cited by examiner

*Primary Examiner*—Chris K. Moore

(57) ABSTRACT

A drain opening device for clearing and opening a slow or clogged drain using a blower unit. The drain opening device includes a tubular assembly including an elongate tubular member having open top and bottom ends and a bore extending therethrough, and also including a collar being securely attached about the elongate tubular member at said bottom end thereof with the top end of the elongate tubular member being adapted to be connected to a hose from a blower unit and with the bottom end and the collar being adapted to be received in a drain pipe; and also includes a valve assembly being disposed in the bore of said elongate tubular member for preventing a back-flow of air.

7 Claims, 3 Drawing Sheets

DRAIN OPENING DEVICE

BACKGROUND OF THE INVENTION

1. Field of the Invention

The present invention relates to a drain blaster and more particularly pertains to a new drain opening device for clearing and opening a slow or clogged drain using a blower unit.

2. Description of the Prior Art

The use of a drain blaster is known in the prior art. More specifically, a drain blaster heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,193,245; 3,730,209; 2,673,986; 4,141,090; U.S. Pat. No. Des. 155,489; U.S. Pat. No. Des. 404,178; and U.S. Pat. No. 3,062,152.

While these devices fulfill their respective, particular objectives and requirements, the aforementioned patents do not disclose a new drain opening device. The inventive device includes a tubular assembly including an elongate tubular member having open top and bottom ends and a bore extending therethrough, and also including a collar being securely attached about the elongate tubular member at the bottom end thereof with the top end of the elongate tubular member being adapted to be connected to a hose from a blower unit and with the bottom end and said collar being adapted to be received in a drain pipe; and also includes a valve assembly being disposed in said bore of the elongate tubular member for preventing a back-flow of air.

In these respects, the drain opening device according to the present invention substantially departs from the conventional concepts and designs of the prior art, and in so doing provides an apparatus primarily developed for the purpose of clearing and opening a slow or clogged drain using a blower unit.

SUMMARY OF THE INVENTION

In view of the foregoing disadvantages inherent in the known types of drain blaster now present in the prior art, the present invention provides a new drain opening device construction wherein the same can be utilized for clearing and opening a slow or clogged drain using a blower unit.

The general purpose of the present invention, which will be described subsequently in greater detail, is to provide a new drain opening device which has many of the advantages of the drain blaster mentioned heretofore and many novel features that result in a new drain opening device which is not anticipated, rendered obvious, suggested, or even implied by any of the prior art drain blaster, either alone or in any combination thereof.

To attain this, the present invention generally comprises a tubular assembly including an elongate tubular member having open top and bottom ends and a bore extending therethrough, and also including a collar being securely attached about the elongate tubular member at said bottom end thereof with the top end of the elongate tubular member being adapted to be connected to a hose from a blower unit and with the bottom end and the collar being adapted to be received in a drain pipe; and also includes a valve assembly being disposed in the bore of said elongate tubular member for preventing a back-flow of air.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new drain opening device which has many of the advantages of the drain blaster mentioned heretofore and many novel features that result in a new drain opening device which is not anticipated, rendered obvious, suggested, or even implied by any of the prior art drain blaster, either alone or in any combination thereof.

It is another object of the present invention to provide a new drain opening device which may be easily and efficiently manufactured and marketed.

It is a further object of the present invention to provide a new drain opening device which is of a durable and reliable construction.

An even further object of the present invention is to provide a new drain opening device which is susceptible of a low cost of manufacture with regard to both materials and labor, and which accordingly is then susceptible of low prices of sale to the consuming public, thereby making such drain opening device economically available to the buying public.

Still yet another object of the present invention is to provide a new drain opening device which provides in the apparatuses and methods of the prior art some of the advantages thereof, while simultaneously overcoming some of the disadvantages normally associated therewith.

Still another object of the present invention is to provide a new drain opening device for clearing and opening a slow or clogged drain using a blower unit.

Yet another object of the present invention is to provide a new drain opening device which includes a tubular assembly including an elongate tubular member having open top and bottom ends and a bore extending therethrough, and also including a collar being securely attached about the elongate tubular member at said bottom end thereof with the top end of the elongate tubular member being adapted to be connected to a hose from a blower unit and with the bottom end and the collar being adapted to be received in a drain pipe; and also includes a valve assembly being disposed in the bore of said elongate tubular member for preventing a back-flow of air.

Still yet another object of the present invention is to provide a new drain opening device that eliminates having to use dangerous chemicals to open plugged pipes.

Even still another object of the present invention is to provide a new drain opening device that also eliminates having to call a plumber to have him unplug the pipe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
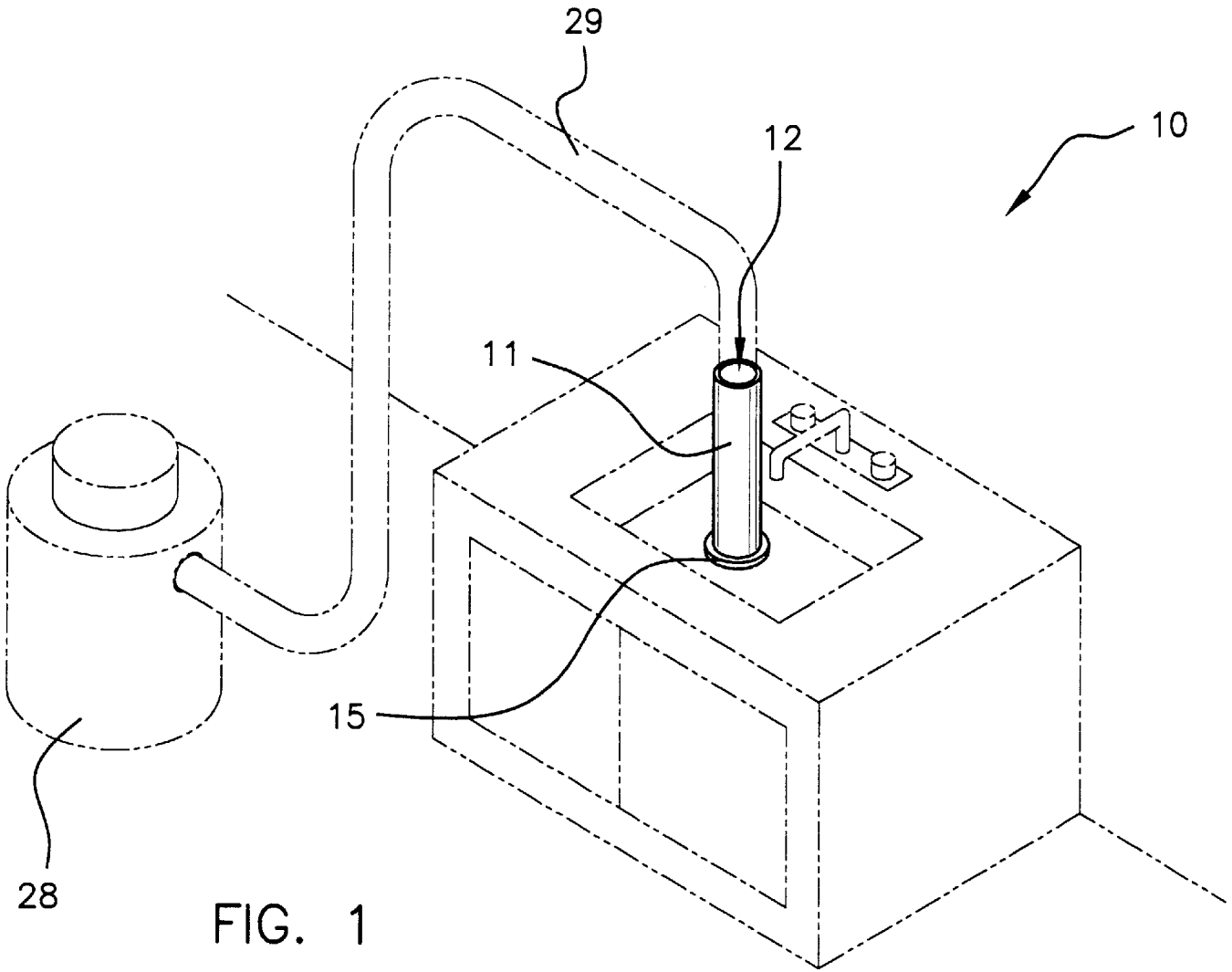
FIG. 1 is a perspective view of a new drain opening device according to the present invention and shown in use.
Figure 2:
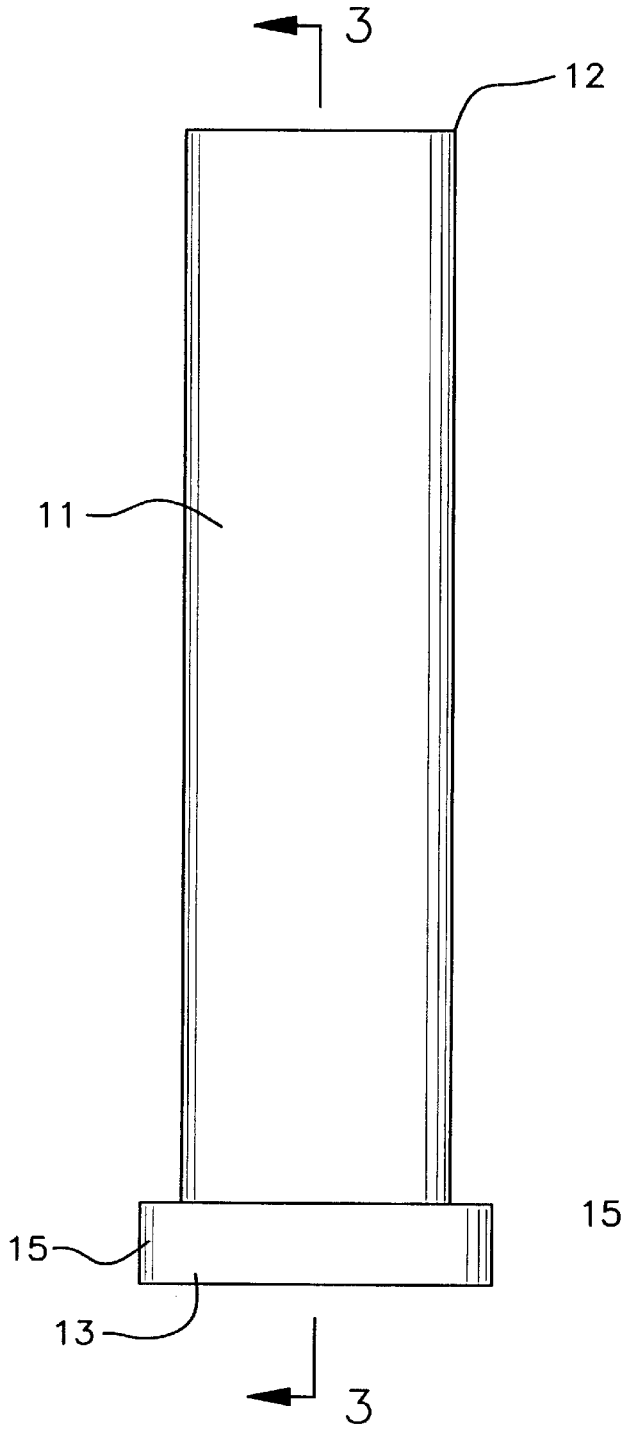
FIG. 2 is a side elevational view of the present invention.
Figure 3:
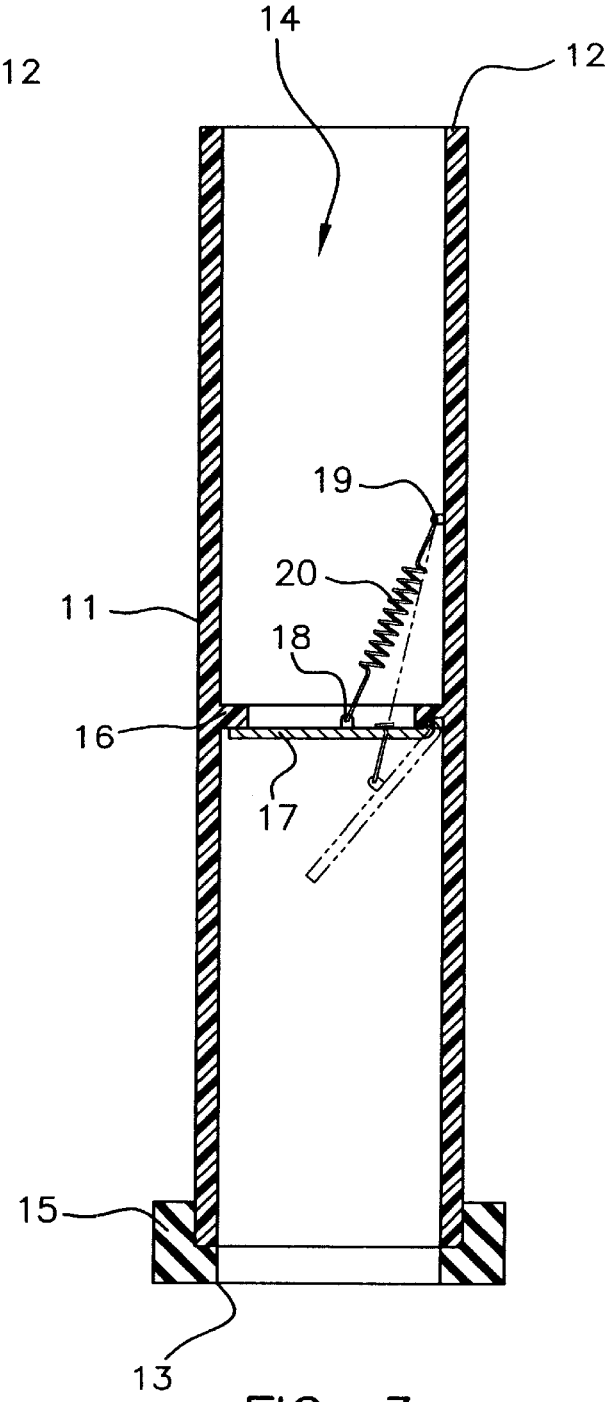
FIG. 3 is a cross-sectional view of the present invention.
Figure 4:
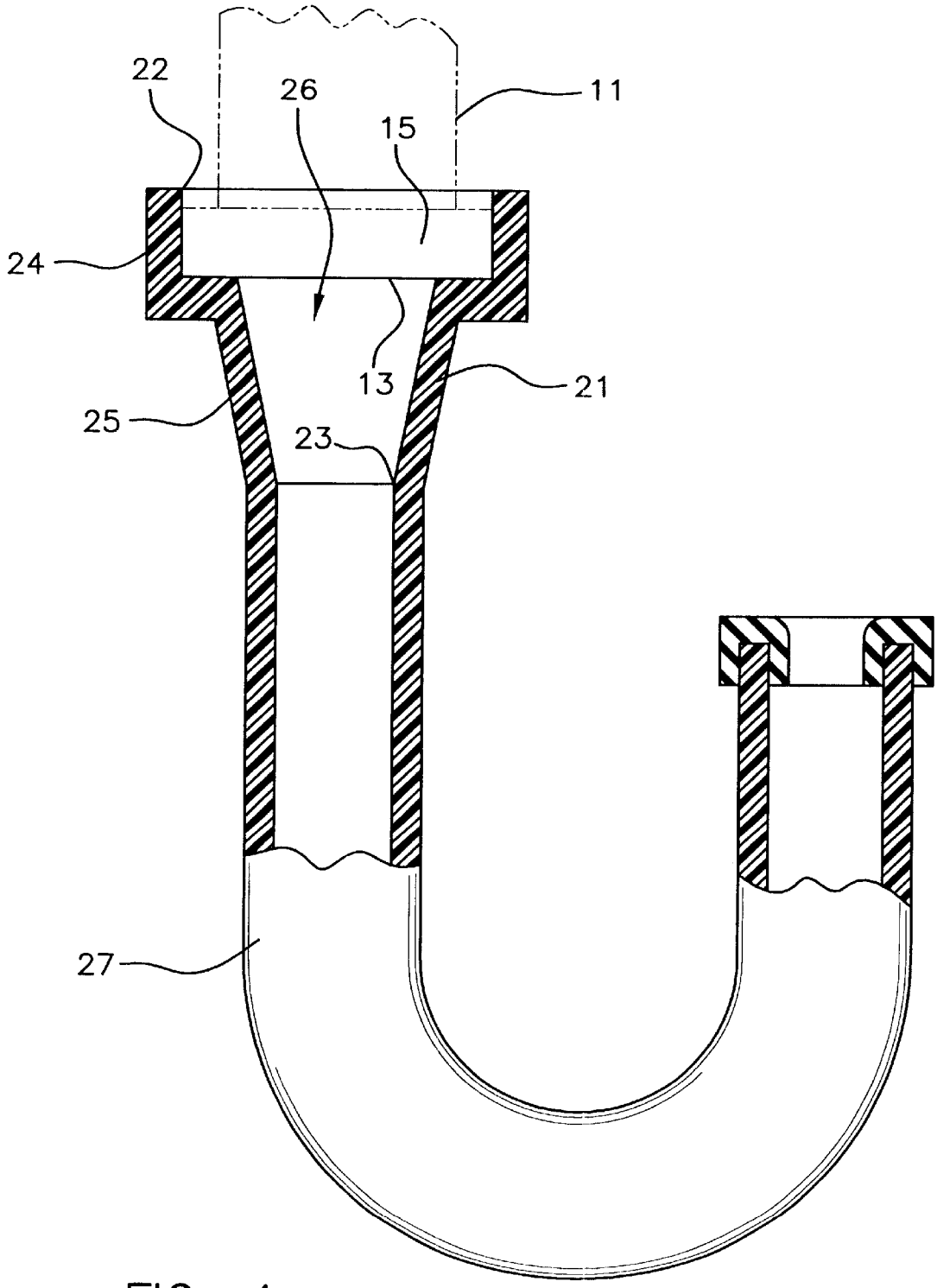
FIG. 4 is a cross-sectional view of a drain pipe to which the present invention is removably attached.

With reference now to the drawings, and in particular to FIGS. 1 through 4 thereof, a new drain opening device embodying the principles and concepts of the present invention and generally designated by the reference numeral 10 will be described.

As best illustrated in FIGS. 1 through 4, the drain opening device 10 generally comprises a tubular assembly including an elongate tubular member 11 having open top and bottom ends 12,13 and a bore 14 extending therethrough, and also includes a collar 15 being securely and conventionally attached about the elongate tubular member 11 at the bottom end 13 thereof. The top end 12 of the elongate tubular member 11 is adapted to be connected to a hose 29 from a blower unit 28. The bottom end 13 and the collar 15 are adapted to be received in a drain pipe 27. The tubular assembly further includes an annular flange 16 being securely and conventionally attached to an interior of a wall of the elongate tubular member 11 inside the bore 14 with the elongate tubular member 11 having a length of approximately 16 inches and a diameter of approximately 2¼ inches.

A valve assembly is conventionally disposed in the bore 14 of the elongate tubular member 11 for preventing a back-flow of air. The valve assembly includes a valve member 17 being hingedly attached to the annular flange 16 for closing the passageway through the bore 14, and also includes an first eyelet 18 being securely and conventionally attached to a top side of the valve member 17, and further includes a second eyelet 19 being securely and conventionally attached to the interior of the wall inside the bore 14, and also includes a spring member 20 being securely and conventionally attached to the first and second eyelets 18,19 for biasing the valve member 17 against the annular flange 16 to close the passageway through the bore 14. The valve member 17 is adapted to pivot downwardly toward the bottom end 13 of the elongate tubular member 11. The second eyelet 19 is disposed between the annular flange 16 and the top end 12 of the elongate tubular member 11.

An adapter member 21 is removably attached to an end of a pipe 27 to be opened. The adapter member 21 is a tubular member having open first and second ends 22,23 and a bore 26 extending therethrough and further having an enlarged first end portion 24 which is adapted to receive the bottom end 13 of the elongate tubular member 11 and the collar 15, and also having a tapered second end portion 25 which is adapted to be connected to the pipe 27.

In use, the user places the bottom end 13 of the elongate tubular member 11 and the collar in the opening of the drain or drain pipe 27, and attaches the hose 29 to the top end 12 of the elongate tubular member 11 and energizes the blower unit 28 which forces air through the elongate tubular member 11 into the drain pipe 27 to open the drain pipe 27. The valve member 18 opens one way and prevents a black flow of air through the elongate tubular member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drain opening device comprising:

a tubular assembly including an elongate tubular member having open top and bottom ends and a bore extending therethrough, and also including a collar being securely attached about said elongate tubular member at said bottom end thereof, said top end of said elongate tubular member being adapted to be connected to a hose from a blower unit, said bottom end and said collar being adapted to be received in a drain pipe; and a valve assembly being disposed in said bore of said elongate tubular member for preventing a back-flow of air.

2. A drain opening device as described in claim 1, wherein said tubular assembly further includes an annular flange being securely attached to an interior of a wall of said elongate tubular member inside said bore.

3. A drain opening device as described in claim 2, wherein said valve assembly includes a valve member being hingedly attached to said annular flange for closing the passageway through said bore, and also includes an first eyelet being securely attached to a top side of said valve member, and further includes a second eyelet being securely attached to said interior of said wall inside said bore, and also includes a spring member being securely attached to said first and second eyelets for biasing said valve member against said annular flange to close said passageway through said bore.

4. A drain opening device as described in claim 3, wherein said valve member is adapted to pivot downwardly toward said bottom end of said elongate tubular member.

5. A drain opening device as described in claim 4, wherein said second eyelet is disposed between said annular flange and said top end of said elongate tubular member.

6. A drain opening device as described in claim 5 further includes an adapter member being removably attached to an end of a pipe to be opened, said adapter member being a tubular member having open first and second ends and a bore extending therethrough and further having an enlarged first end portion which is adapted to receive said bottom end of said elongate tubular member and said collar, and also having a tapered second end portion which is adapted to be connected to the pipe.

7. A drain opening device comprising:

a tubular assembly including an elongate tubular member having open top and bottom ends and a bore extending therethrough, and also including a collar being securely attached about said elongate tubular member at said bottom end thereof, said top end of said elongate tubular member being adapted to be connected to a hose from a blower unit, said bottom end and said collar being adapted to be received in a drain pipe, said tubular assembly further including an annular flange being securely attached to an interior of a wall of said elongate tubular member inside said bore, said elongate tubular member having a length of approximately 16 inches and a diameter of approximately 2¼ inches;

a valve assembly being disposed in said bore of said elongate tubular member for preventing a back-flow of air, said valve assembly including a valve member being hingedly attached to said annular flange for closing the passageway through said bore, and also including an first eyelet being securely attached to a top side of said valve member, and further including a second eyelet being securely attached to said interior of said wall inside said bore, and also including a spring member being securely attached to said first and second eyelets for biasing said valve member against said annular flange to close said passageway through said bore, said valve member being adapted to pivot downwardly toward said bottom end of said elongate tubular member, said second eyelet being disposed between said annular flange and said top end of said elongate tubular member; and an adapter member being removably attached to an end of a pipe to be opened, said adapter member being a tubular member having open first and second ends and a bore extending therethrough and further having an enlarged first end portion which is adapted to receive said bottom end of said elongate tubular member and said collar, and also having a tapered second end portion which is adapted to be connected to the pipe.

* * * * *